US007174609B2

(12) United States Patent
Park

(10) Patent No.: US 7,174,609 B2
(45) Date of Patent: Feb. 13, 2007

(54) BUCKLE

(76) Inventor: Nam-Il Park, 230-147 Jangwi-Dong Sung Book-Ku, Seoul (KR)

( * ) Notice: Subject to any disclaimer, the term of this patent is extended or adjusted under 35 U.S.C. 154(b) by 60 days.

(21) Appl. No.: 11/006,760

(22) Filed: Dec. 8, 2004

(65) Prior Publication Data

US 2005/0204522 A1 Sep. 22, 2005

(30) Foreign Application Priority Data

Mar. 19, 2004 (KR) ..... 10-2004-0018651

(51) Int. Cl.
*A44B 11/25* (2006.01)

(52) U.S. Cl. ..... 24/614; 24/615; 24/625

(58) Field of Classification Search ..... 24/614, 24/615, 616, 617, 625
See application file for complete search history.

(56) References Cited

U.S. PATENT DOCUMENTS 5,590,444 A * 1/1997 Krauss ..... 24/625
5,791,026 A * 8/1998 Anscher ..... 24/615
6,247,213 B1 * 6/2001 Uehara ..... 24/625
6,622,355 B2 * 9/2003 Buscart et al. ..... 24/615
7,024,734 B2 * 4/2006 Anscher ..... 24/625

* cited by examiner

*Primary Examiner*—Robert J. Sandy
(74) *Attorney, Agent, or Firm*—Westerman, Hattori, Daniels & Adrian, LLP.

(57) ABSTRACT

A buckle having a plug member and a socket member designed to detachably engaged to each other. The plug member includes a base portion, a pair of engaging legs extended from the base portion such that the engaging legs may be resiliently engaged to the socket member, and a guide rod extended from the base portion between the engaging legs. The socket member includes a chamber opened at a leading end thereof, so as to receive the engaging legs and the guide rod of the plug member, and a pair of latching portions defined within the socket member such that respective leading ends of the engaging legs may be latched into the latching portions. The socket member comprises substantially triangular-shaped upper and lower plates having opposite lateral sides gradually converging towards the leading end of the socket so as to form opposite tapered side surfaces of the socket member.

8 Claims, 6 Drawing Sheets

PRIOR ART
[Fig. 1]
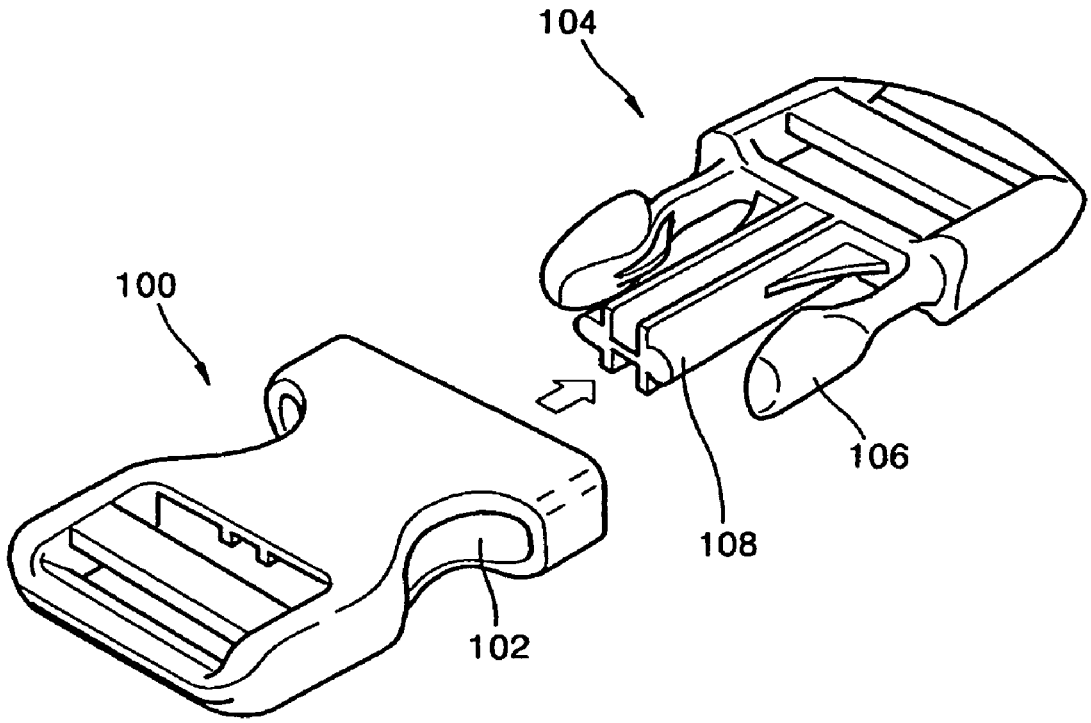

[Fig. 2]
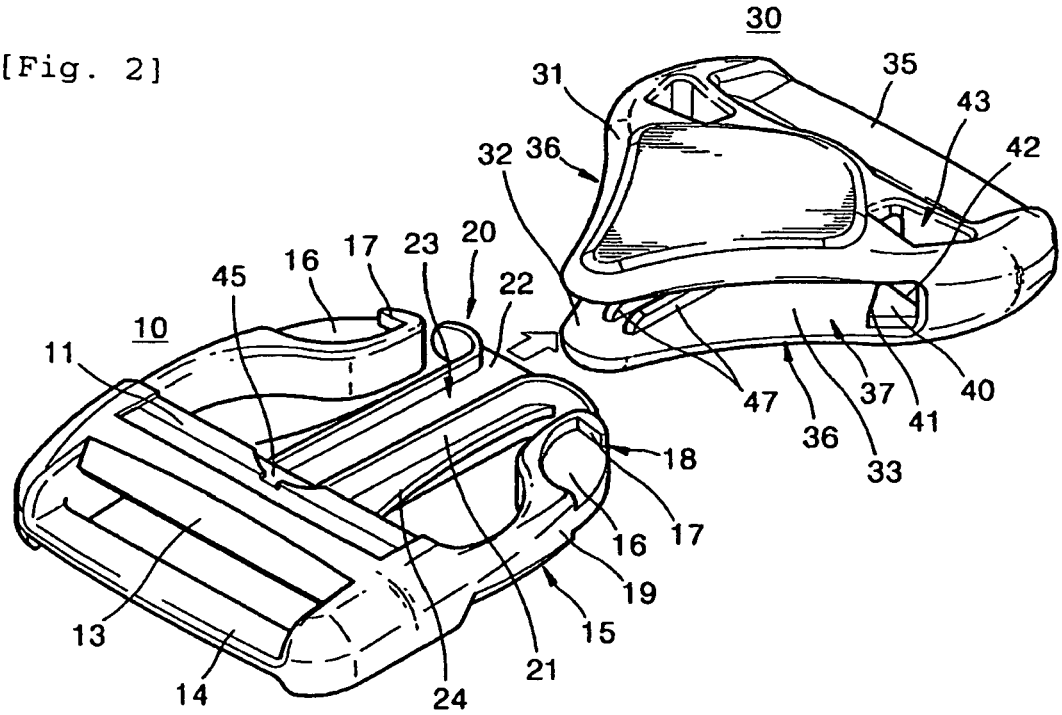
[Fig. 3]
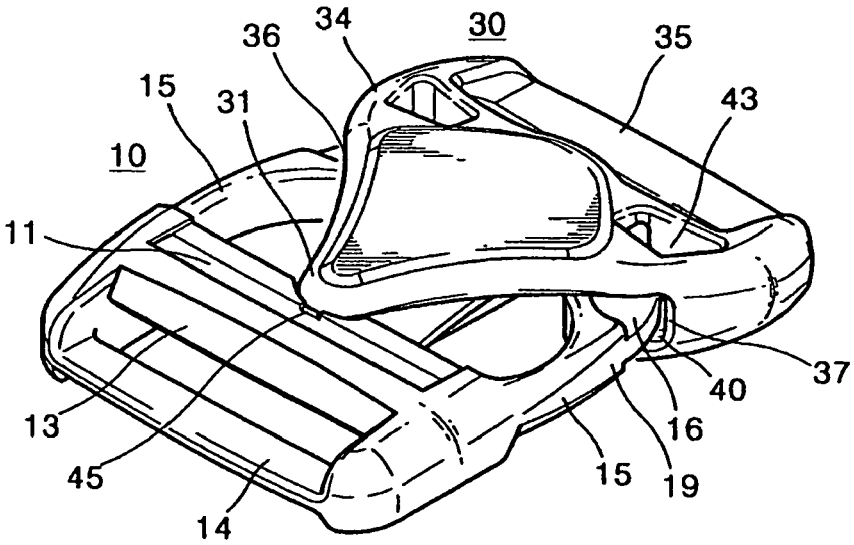

[Fig. 4]
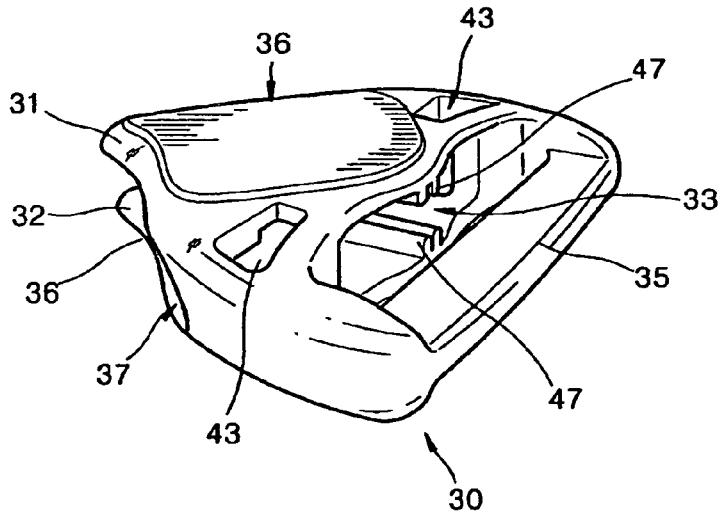
[Fig. 5]
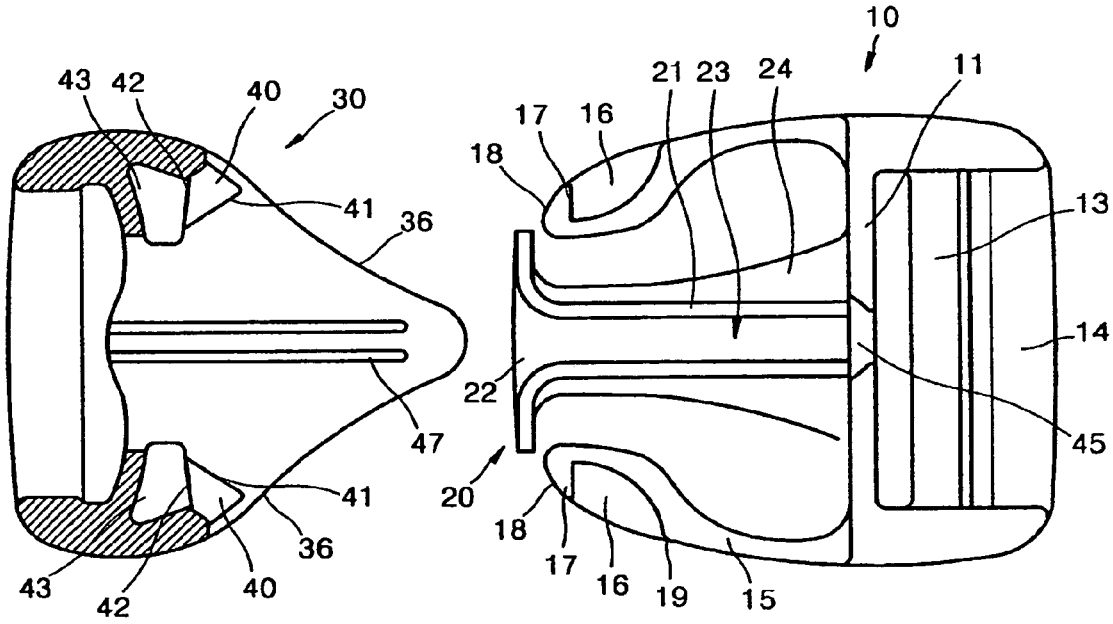

[Fig. 6]
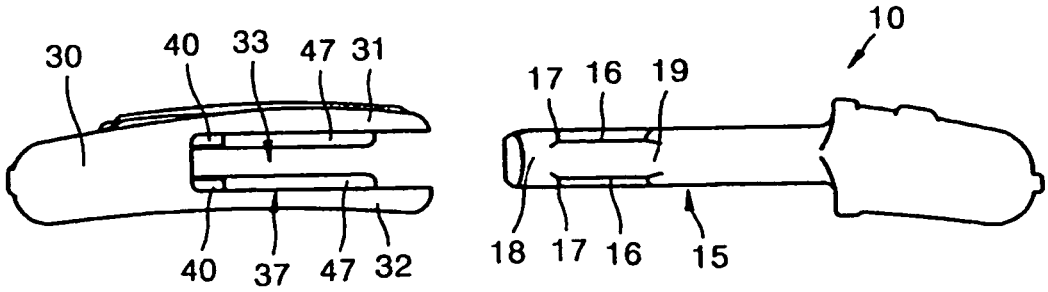
[Fig. 7]
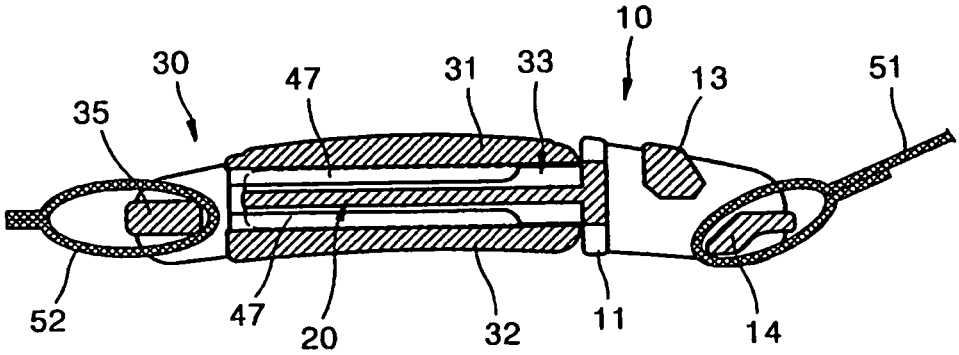

[Fig. 8]
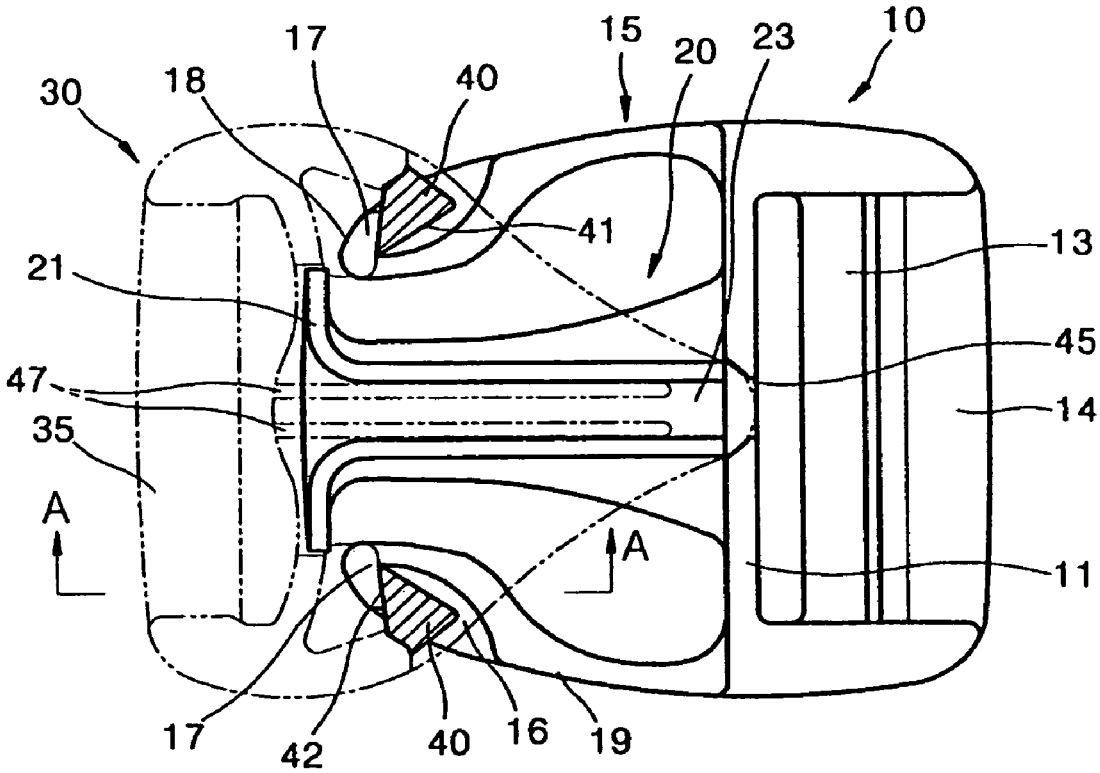
[Fig. 9]
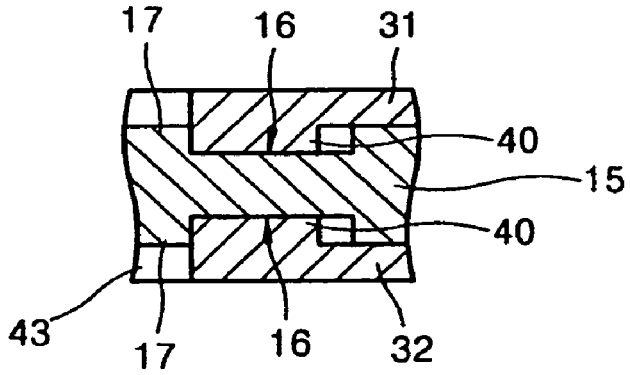

[Fig. 10]
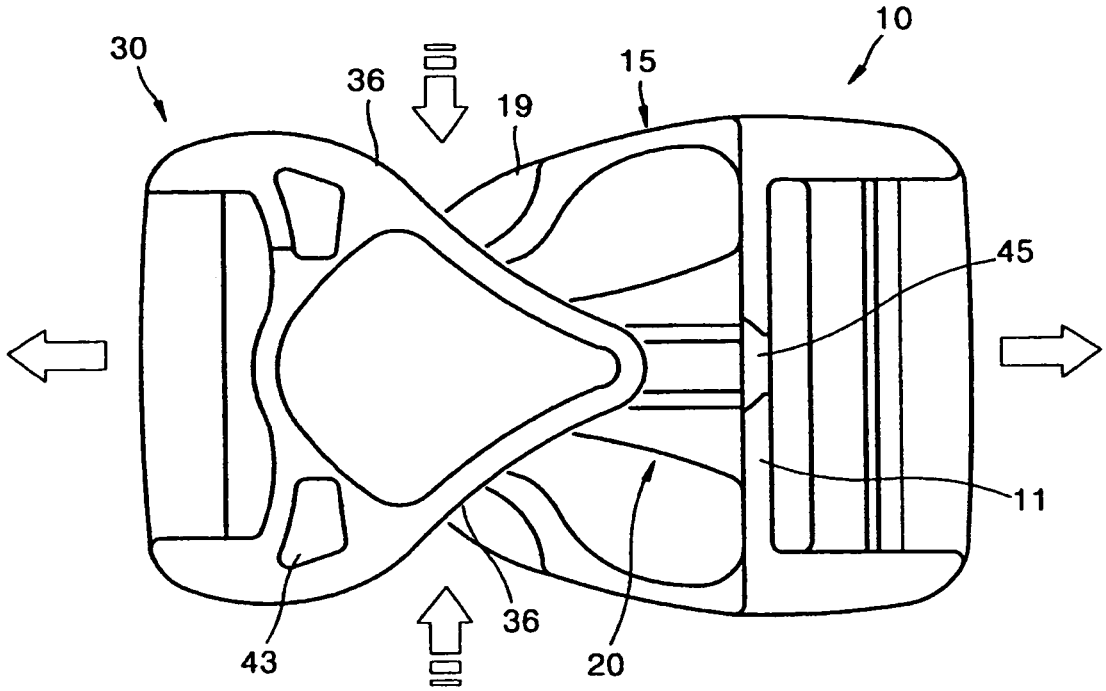
[Fig. 11]
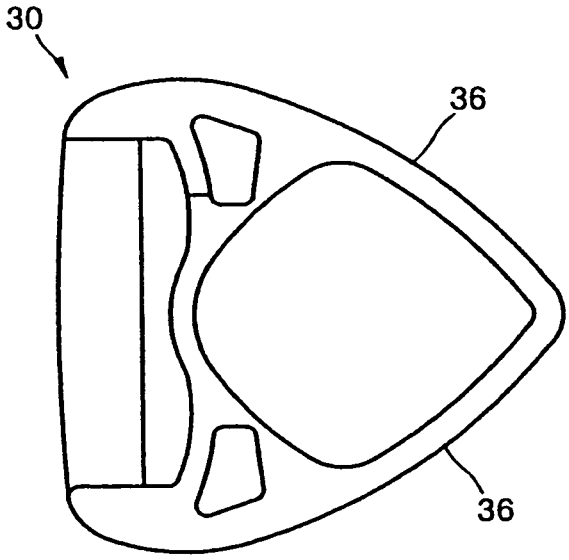

BUCKLE

BACKGROUND OF THE INVENTION

1. Field of the Invention

The present invention relates to a buckle, and more particularly to a buckle, which comprises a plug member, and a socket member attached to a free end of a belt connected to a variety of articles, such as knapsacks, bags, clothes, helmets, etc., so that these members can be detachably engaged to each other.

2. Description of the Related Art

Generally, a buckle has a construction wherein two engaging members, such as a plug member and a socket member, are engaged to each other, allowing easy disengagement. These engaging members are formed of a plastic material so as to provide elasticity to the buckle.

FIG. 1 is a schematic perspective view illustrating a conventional buckle, which comprises a socket member 100 and a plug member 104.

Referring to FIG. 1, the socket member 100 has a chamber opened at a leading end of the socket member, and a pair of slots 102 defined respectively at opposite sides of the socket member 100 so as to face each other. The plug member 104 has a pair of engaging legs 106, and a guide member 108 straightly extended between the engaging legs 106. Each of the engaging legs 106 is straightly extended at either side of a body of the plug member 104 so as to provide resiliency, and has an engaging portion outwardly protruded from a leading end of the engaging leg 106.

When the plug member 104 is inserted into the chamber from the leading end of the socket member 100, the pair of engaging legs 106 provided at opposite sides of the plug member 104 slides along inner walls of the socket member 100 while being resiliently bent inward within the socket member 100. Then, when the leading ends of the engaging legs 106 are located in the slots 102, the engaging legs 106 are resiliently returned outward, and firmly seated in the socket member 100, thereby allowing the plug member 104 to be engaged to the socket member 100.

In order to disengage the plug member 104 from the socket member 100, the opposite sides of the engaging legs 106 are pressed inward at the same time, and then the engaging legs 106*a* are retracted from the socket member 100, so that each of the engaging legs 106 is removed from respective slots 102 of the socket member 100, thereby allowing the plug member 104 to be disengaged from the socket member 100.

However, according to the conventional buckle, in order to allow the engaging legs 106 to be stably engaged to the respective slots 102 of the socket member 100, the engaging legs 106 are designed to have a high elastic strength, so that a high engaging force is imparted between the engaging legs 106 and the socket member 100. As a result, the plug member 104 and the socket member 100 can be firmly engaged to each other. However, in order to disengage the plug member 104 from the socket member 100, since a relatively high pressure must be applied to the engaging legs 106, it is not easy to disengage the plug member 104 from the socket member 100.

Furthermore, the conventional buckle has a problem in that foreign matter, such as dirt and the like, can be easily accumulated within the socket member 100 or around the engaging legs 106, causing impediment upon engagement of the socket member 100 and the plug member 104. The conventional buckle also has problems in that, since the leading end of the plug member 104 is opened due to a space defined between each engaging leg 104 and the guide member 100, the plug member 104 can be attached to or captured by external substances upon contact with the substances, causing inconvenience in use, and in that the conventional buckle has a complicated configuration, thereby increasing manufacturing costs thereof.

SUMMARY OF THE INVENTION

The present invention has been made to solve the above problems, and it is an object of the present invention to provide a buckle, designed not only to provide a wide space to the configuration of members constituting the buckle, thereby simplifying the configuration of the buckle, but also to provide specific elasticity and flexibility to engaging legs of a plug member, thereby providing convenience in use of the buckle, and reducing manufacturing costs thereof.

It is another object of the present invention to provide the buckle, designed to allow easy engagement and disengagement, and in particular, to allow the plug member and a socket member to be automatically separated from each other simultaneously with releasing an engaging state of the buckle upon disengagement of the buckle.

It is still another object of the present invention to provide the buckle, designed to have various and elegant appearance.

It is still another object of the present invention to provide the buckle, designed to have simple configuration, and to provide a stable engagement state while allowing easy engaging and disengagement of the buckle.

It is yet another object of the present invention to provide the buckle, designed to reduce interference against respective protrusions or a space between the protrusions with external substances as much as possible, thereby providing convenience in use of the buckle.

In accordance with one aspect of the present invention, the above and other objects can be accomplished by the provision of a buckle, comprising: a plug member and a socket member detachably engaged to each other, the plug member including a base portion, a pair of engaging legs extended from the base portion such that the engaging legs may be resiliently engaged to the socket member, and a guide rod extended from the base portion between the engaging legs, and the socket member including a chamber opened at a leading end of the socket member so as to receive the engaging legs and the guide rod of the plug member, and a pair of latching portions defined within the socket member such that respective leading ends of the engaging legs may be latched into the latching portions, wherein the socket member comprises substantially triangular-shaped upper and lower plates having opposite lateral sides gradually converging towards the leading end of the socket so as to form opposite tapered side surfaces of the socket member, each having a slot extended from an entrance of the chamber so as to communicate with the interior of the chamber.

The tapered side surfaces may have a linear surface. Preferably, the tapered side surfaces may have a convexly rounded surface or a concavely rounded surface.

The engaging legs may be extended from the base portion so as to be bent inward in a state of facing each other, so that, when the engaging legs are engaged to the socket member, outer sides of the engaging leg are located to the tapered side surfaces of the socket member, respectively. Accordingly, the present provides convenience in that only a simple releasing operation of pressing overlapped portions between the socket member and the outer sides of the plug member enables the socket member and the plug member to be separated from each other, as soon as engagement between the socket member and the plug member is released by the releasing operation.

The plug member may have mounting portions formed on upper and lower surfaces of the base portion, respectively, to allow the leading end of the socket member corresponding to one corner of the triangular-shaped socket member to be stably mounted on the plug member, thereby preventing the socket member from moving within the socket member, and maintaining a stable engagement state between the plug member and the socket member.

Each of the engaging legs may have engaging recesses opened outwardly while being depressed on upper and lower surfaces of a leading end of the engaging leg such that, when the plug member is engaged to the socket member, the latching portions of the socket member are located on the engaging recesses, respectively, and hook-shaped engaging jaws protruded adjacent to the engaging recesses on the upper and lower surfaces of the engaging leg such that the engaging jaws act as side walls for the respective engaging recesses to partially enclose the engaging recesses, respectively. Accordingly, engagement and disengagement of the buckle can be performed with minimal resilient operation to allow the buckle to be engaged or disengaged with a relatively low force, thereby providing the convenience in use of the buckle.

The guide rod may be extended from the middle of the base portion, and have shielding flanges, each being extended perpendicular to the guide rod from a leading end of the guide rod while being located adjacent to the leading end of an associated engaging leg, shielding an entrance of a space between the engaging leg and the guide rod. Accordingly, the entrance of the space between the engaging leg and the guide rod is shielded by means of the shielding flanges, so that, when the buckle contacts the external substances, interference between the spaces or protrusions, such as the guide rod and engaging legs, and the substances can be minimized, thereby providing convenience in use of the buckle.

The socket member may have openings formed at both sides of the upper and lower plates in order to allow the latching portions having the engaging recesses located thereon to be formed by means of molding, thereby providing convenience in manufacturing.

BRIEF DESCRIPTION OF THE DRAWINGS

The foregoing and other objects and features of the present invention will be more clearly understood from the following detailed description taken in conjunction with the accompanying drawings, in which:

FIG. 1 is a schematic perspective view illustrating a conventional buckle;

FIG. 2 is a schematic perspective view illustrating a buckle according to one embodiment of the present invention;

FIG. 3 is a view illustrating the buckle of FIG. 2 in an engaged state;

FIG. 4 is a rear perspective view illustrating a socket member of the buckle according to one embodiment of the present invention;

FIG. 5 is a partial top view illustrating the buckle according to one embodiment of the present invention in a disengaged state;

FIG. 6 is a side view illustrating the buckle according to one embodiment of the present invention in a disengaged state;

FIG. 7 is a side elevation illustrating the buckle according to one embodiment of the present invention in the engaged state;

FIG. 8 is a top view illustrating the buckle according to one embodiment of the present invention in the engaged state;

FIG. 9 is a cross-sectional view taken along the line A—A of FIG. 8;

FIG. 10 is a top view illustrating the buckle according to one embodiment of the present invention in the disengaged state; and FIG. 11 is a top view illustrating a socket member of the buckle according to another embodiment of the present invention.

DESCRIPTION OF THE PREFERRED EMBODIMENTS

Preferred embodiments of the present invention will now be described in detail with reference to the accompanying drawings, in which the same components as those of the conventional buckle are denoted by the same reference numerals.

FIG. 2 is an exploded perspective view of a buckle according to one embodiment of the invention, and FIG. 3 shows the buckle of FIG. 2 in an engaged state. FIG. 4 is a perspective view illustrating a socket member of the buckle seen in another direction. FIG. 5 is a top view illustrating the buckle in a disengaged state, and partially illustrating a transverse section of the socket member, FIG. 6 is a side view illustrating the buckle in the disengaged state, and FIG. 7 is a side elevation illustrating the buckle in the engaged state.

Referring to FIGS. 2 to 7, the buckle of the present invention comprises a plug member 10 and a socket member 30 detachably engaged to each other. These members are generally formed of synthetic resins, and can be used in a state of being connected to respective free ends of belts 51 and 52.

The plug member 10 has a base portion 11, a belt-hooking rod 13 formed at a rear portion of the base 11 such that the free end of the belt 51 can be wound around the belt-hooking rod 13, a belt-coupling rod 14 to fix the belt 51 spaced a predetermined distance from the belt-hooking rod 13 in parallel to the belt-hooking rod 13, and a pair of engaging legs 15 extended forward at opposite sides of the base portion 11.

Each of the engaging legs 15 is thin and is extended from the base portion 11 in the longitudinal direction, such that the engaging leg 15 can be resiliently bent against the base portion 11, and is then expanded at a leading end thereof. The engaging legs 15 are symmetrically disposed at both sides of the plug member 10. More specifically, the engaging legs 15 are extended from the base portion 11 in a manner that each of the engaging legs 15 is slanted toward the center of the plug member 10 while having a gently curved outer surface, thereby allowing the respective leading ends of the engaging legs 15 to converge to each other.

Each of the engaging legs 15 has engaging recesses 16 symmetrically depressed at the leading end of the engaging leg 15 on upper and lower surfaces of the engaging leg 15 while being opened outwardly, hook-shaped engaging jaws 17 protruded adjacent to the engaging recesses 16 on the upper and lower surfaces of the engaging leg 15 while being curved outwardly, such that the engaging jaws 17 can act as side walls for the respective engaging recesses 16 to partially enclose the engaging recesses 16, respectively, and a rounded contact surface 18 at the leading end of the engaging leg 15.

The respective outer surfaces of the engaging leg 15 act as grip surfaces 19 for disengaging the buckle. Each of the grip surfaces 19 is provided with a means, such as an irregular feature, for preventing slippage of the buckle when grasping the buckle.

The plug member 10 further includes a guide rod 20 extended forward from the base portion 11 between the engaging legs 15. The guide rod 20 is bent in opposite directions perpendicular to the guide rod 20 at a leading end of the guide rod 20, and thus provides shielding flanges extended adjacent to the leading ends of associated engaging legs 15, thereby shielding entrances of spaces between the engaging legs 15 and the guide rod 20, respectively.

The guide rod 20 includes a pair of guide walls 21 facing each other, and a bridge portion 22 located between the guide walls 21 to connect the guide walls 21 in the longitudinal direction, thereby forming guide recesses 23 extended on upper and lower surfaces of the guide rod 20. The guide rod 20 further comprises wings 24 formed at outer side surfaces of the guide walls 21 and extended along the guide rod 20 in order to reinforce the guide rod 20.

The socket member 30 comprises upper and lower plates 32 defining a chamber 33 therebetween to guide and receive the plug member 10, and a belt-attaching rod 35 transversely provided at a rear portion of the socket member 30 to fix a free end of the belt 52.

The upper and lower plates 31 and 32 of the socket member 30 are disposed symmetrically, and have a substantially triangular shape. Thus, the socket member 30 may have opposite lateral sides gradually converging to the leading end of the socket member 30 so as to form opposite tapered side surfaces 36, each of which has a slot 37 extended from an entrance of the chamber 33, that is, the leading end of the socket member 30, so that the chamber 33 within the socket member 30 is opened at the front side and the lateral sides, while being partially opened at the rear side of the socket 30.

The socket member 30 further comprises two pairs of latching portions 40 symmetrically protruded at both sides of upper and lower portions within the socket member 30 such that the engaging legs 15 of the plug member 10 can be latched into the latching portions 40. Each of the latching portions 40 can be seen through the associated slot 37 of the tapered side surface 36, and comprises a guide jaw 41 obliquely provided inward from the leading end of the guide jaw 41, and a latching jaw 42 sharply slopped at the rear end of the guide jaw 41. Each of the slots 37 is formed from the leading end of the socket member 30 to the outside of the latching portions 40.

The dimensions of each guide jaw 41 of the latching portions 40 are previously determined such that, when the plug member 10 is initially inserted into the socket member 30, the respective contact surfaces 18 of engaging legs 15 contact the guide jaws 41 at first, and such that when the plug member 10 is finally inserted into the socket member 30, the latching portions 40 are located on the engaging recesses 16 of the engaging legs 15 to allow the hook-shaped engaging jaws 17 to be latched to the latching jaws 42, respectively. Additionally, the upper and lower plates 31 and 32 of the socket member 30 have openings 43 penetrating the socket member 30 while defining the latching jaws 42 of the latching portions 40, respectively, so as to form the latching portions 40 by means of molding. Accordingly, when the plug member 10 is engaged to the socket member 30, the leading ends of the engaging member 15 are located within the openings 43.

When the plug member 10 is engaged to the socket member 30, respective leading ends of the upper and lower plates 31 and 32 of the socket member 30 are mounted on the base portion of the plug member 10. At this time, in order to allow the leading ends of the upper and lower plates 31 and 32 of the socket member 30 to be stably mounted on the base portion 11, the base portion 11 has mounting portions 45 formed on the middle of upper and lower surfaces of the base portion 11, respectively. Preferably, the mounting portions 45 have groove shapes corresponding to the shapes of the leading ends of the upper and lower plates 31 and 32, and is one of the most important means to maintain a stable engagement state between the plug member 10 and the socket member 30.

The chamber 33 of the socket member 30 has guide rails 47 extended longitudinally along the center of the upper and lower plates 31 and 32, respectively, and thus, when the plug member 10 is engaged to the socket member 30, the guide rails 47 can be received in the upper and lower guide recesses 23 of the guide rod 20, thereby guiding smooth insertion of the plug member 10 into the socket member 30. Such a coupling between the guide recesses 23 of the guide rod 20 and the guide rails 47 is one of the most important means to firmly maintain engagement between the plug member 10 and the socket member 30.

As seen from the lateral side of the buckle, both the plug member 10 and the socket member 30 have appropriate round surfaces to allow the buckle to closely contact the body of the wearer, thereby increasing comfort.

Operations of the buckle constructed as described above according to the present invention will now be described.

In order to engage the buckle, as the plug member 10 is inserted into the chamber 33 through the entrance of the socket member 30, the guide rod 20 of the plug member 10 is guided along the guide rail 47 of the socket member 30, thereby allowing the plug member 10 to be linearly inserted into the chamber 33. Then, the contact surfaces 18 of the respective engaging legs 15 contact the guide jaws 14 of the associated latching portions 40, so that the respective engaging legs 15 are resiliently bent inward along the side surfaces of the guide jaws 41. As the plug member 10 continues to be inserted into the socket member 30, the latching portions 40 are located on the engaging recesses 16 of the engaging legs 15, respectively, so that contacts between the contact surfaces 18 and the guide jaws 41 are released, and at the same time, the leading ends of the engaging legs 15 are resiliently biased outward and return to their original states by virtue of elastic force of the engaging legs 15, whereby the engaging jaws 17 are located at the rear portions of the latching portions 40 and coupled to the latching jaws 42 of the latching portions 40, respectively.

The engaging state of the plug member 10 and the socket member 30 as described above is illustrated as a side elevation and a top view in FIGS. 7 and 8, respectively.

Referring to the drawings, when the plug member 10 is completely engaged to the socket member 30, the latching portions 40 are located on the engaging recesses 16, and the leading ends of the engaging legs 15 are located within the openings 43 of the upper plate 31 and the lower plate 32, respectively. Additionally, as shown in FIG. 9, the engaging jaws 17 are coupled to the latching jaws 42, respectively, thereby preventing the plug member 10 from being separated from the socket member 30.

In a state wherein the plug member 10 is engaged to the socket member 30, since the outer surfaces of the engaging legs 15 of the plug member 10, that is, the grip surfaces 19 contact the tapered side surfaces 36 of the socket member 30, intersecting portions between the grip surfaces 19 of the plug member 10 and the tapered side surfaces 36 of the socket member 30 are defined to have concave shapes when viewed from above, respectively.

Additionally, in the state wherein the plug member 10 is engaged to the socket member 30, the leading ends of the upper and lower plates 31 and 32 of the socket member 30 are mounted on the mounting portions 45 formed on the upper and lower surfaces of the base portion 11 of the plug member 10, and the guide rails 47 of the socket member 30 are received within the guide recesses 23 of the guide rod 20, so that the plug member 10 can be kept stably engaged to the socket member 30 without moving therein, and so that the shielding flanges provided at the leading end of the guide rod 20 shield the spaces defined at the rear portion of the chamber 33.

In order to separate the plug member 10 from the socket member 30, as shown in FIG. 10, the engaging legs 15 are bent inward by pressing both of the grip surfaces 19 of the plug member 10 inward, and then the engaging jaws 17 are released from a latched state with the latching jaws 42, thereby allowing the plug member 10 to be retracted from the socket member 30.

Here, the pressing force against the grip surfaces 19 of the plug member 10 acts as a force to allow the plug member 10 to be slipped on the tapered side surfaces 36 of the socket member 30 and then pushed away from the socket member 30 as soon the engaging legs 15 are pressed inward. Accordingly, it is not necessary to provide a pulling force for the plug member 10 in addition to the pushing force against the grip surfaces 19 of the plug member 10. In particular, since all of the outer surfaces of the engaging legs 15 of the plug member 10 and the tapered side surfaces of the socket member 30 have surfaces inclined towards the contact intersecting portions, simply pressing the outer surfaces of the engaging legs 15 of the plug member 10 or any portions near the tapered side surfaces 36 of the socket member 30 without accurately pressing the grip surfaces 19 results in concentration of the pressing force on appropriate pressing locations on the grip surfaces 19 of the plug member 10, thereby releasing the engaging state between the engaging legs and the latching portions, and separating the plug member 10 from the socket member 30.

Such an operation provides an advantageous effect of allowing convenient disengagement of the buckle.

The tapered side surfaces 36 of the socket member 30 can have a straight surface. However, as shown in FIGS. 2 to 10, the tapered side surfaces 36 preferably have a concavely rounded surface, and alternatively, as shown in FIG. 11, the tapered side surfaces 36 may have a convexly rounded surface.

In the buckle of the present invention, the socket member 30 has the substantially triangular shape, and is opened at the lateral sides thereof, thereby providing an elegant appearance to the buckle. Additionally, due to such a configuration of the socket member of the invention, an insertion resistance against the plug member 10 is low, and upon disengagement between the plug member 10 and the socket member 30, the disengagement between the plug member 10 and the socket member 30 can be simultaneously performed simply by pressing the lateral sides of the buckle, thereby allowing the buckle to be coupled and disengaged with a relatively low force.

Moreover, the shielding flanges provided at the leading end of the guide rod 20 shield the entrance of the spaces between the engaging legs and guide rod 20, and thus prevent interference with or attachment of external substances, thereby allowing the buckle to be stably used.

The present invention is not limited to the embodiments described above, and can be realized in various modifications without departing from the spirit of the invention. For instance, the belt-attaching portion of the triangular socket member 30 may have various shapes, and the shapes of the engaging recesses 16, the engaging jaws 17, and the guide rod 20 may be varied according to implementations of the present invention.

As apparent from the above description, according to the present invention, the plug member and the socket member can be simplified in configuration by means of the spaces defined in the respective members, thereby providing advantageous effects of preventing external substances from being attached to the buckle or interfering with the buckle, and of allowing convenient engagement and disengagement of the buckle.

In particular, the outer surfaces of the engaging legs 15 of the plug member are curved inward, and the tapered side surfaces 36 of the socket member 30 are adapted to allow a force for releasing the buckle and a force for pushing the plug member and the socket member oppositely to each other to be simultaneously applied to the buckle, thereby providing convenience in operation of the buckle.

Moreover, the guide rails 47 received in the upper and lower guide recesses 23 of the guide rod 20, and the mounting portions 45 for mounting the leading ends of the upper and lower plates 31 and 32 of the socket member 30 provide an advantageous effect of maintaining a stable engagement of the buckle.

Moreover, the wings 24 formed at the outer side surfaces of the guide walls 21 maintain the rigidity of the guide rod 20, thereby providing an advantageous effect of maintaining the rigidity of the entire plug member 10.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A buckle, comprising: a plug member and a socket member detachably engaged to each other, the plug member including a base portion, a pair of engaging legs extended from the base portion such that the engaging legs may be resiliently engaged to the socket member, and a guide rod extended from the base portion between the engaging legs, and the socket member including a chamber opened at a leading end of the socket member so as to receive the engaging legs and the guide rod of the plug member, and a pair of latching portions defined within the socket member such that respective leading ends of the engaging legs may be latched into the latching portions, wherein the socket member comprises substantially triangular-shaped upper and lower plates having opposite lateral sides gradually converging towards the leading end of the socket so as to form opposite tapered side surfaces of the socket member, each having a slot extended from an entrance of the chamber so as to communicate with an interior of the chamber, wherein each of the engaging legs includes engaging recesses opened outwardly while being depressed on upper and lower surfaces of the leading end of the engaging leg, such that, when the plug member is engaged to the socket member, the latching portions of the socket member are located on the engaging recesses, and hook-shaped engaging jaws protruded adjacent to the engaging recesses on the upper and lower surfaces of the engaging leg such that the engaging jaws act as side walls for the respective engaging recesses to partially enclose the engaging recesses, respectively.

2. The buckle according to claim 1, wherein the tapered side surfaces have a convexly rounded surface.

3. The buckle according to claim 1, wherein the tapered side surfaces have a concavely rounded surface.

4. The buckle according to claim 1, wherein the engaging legs are extended from the base portion so as to be bent inward in a state of facing each other, so that, when the engaging legs are engaged to the socket member, outer sides of the engaging legs are located to the tapered side surfaces of the socket member, respectively.

5. The buckle according to claim 1, wherein the plug member has mounting portions formed on upper and lower surfaces of the base portion, respectively, to allow the triangular leading ends of the upper and lower plates of the socket member to be stably mounted on the plug member.

6. The buckle according to claim 1, wherein the socket member has openings formed at both sides of the upper and lower plates in order to allow the latching portions to be formed by means of molding.

7. The buckle according to claim 1, wherein the guide rod is extended from a middle of the base portion, and includes shielding flanges, each being extended perpendicular to the guide rod from a leading end of the guide rod while being located adjacent to the leading end of an associated engaging leg, so as to shield an entrance of a space between the engaging leg and the guide rod.

8. The buckle according to claim 7, wherein the guide rod further includes wings formed along outer side surfaces of the guide walls.

* * * * *